US009480382B2

(12) United States Patent
Caillou et al.

(10) Patent No.: US 9,480,382 B2
(45) Date of Patent: Nov. 1, 2016

(54) DEVICE COMPRISING A CLEANING HEAD AND A SYSTEM FOR SWITCHING BETWEEN TWO SURFACES

(71) Applicants: Concept Microfibre, Valliquerville (FR); Aquastar China Inc., Qingdao (CN)

(72) Inventors: Francois Caillou, Caudebec en Caux (FR); Rikard Hedlund, Studio City, CA (US)

(73) Assignees: Concept Microfibre, Valliquerville (FR); Aquastar China Inc., Qingdao (CN)

( * ) Notice: Subject to any disclaimer, the term of this patent is extended or adjusted under 35 U.S.C. 154(b) by 123 days.

(21) Appl. No.: 14/492,603

(22) Filed: Sep. 22, 2014

(65) Prior Publication Data

US 2015/0082571 A1 Mar. 26, 2015

(30) Foreign Application Priority Data

Sep. 25, 2013 (FR) ..... 13 59251

(51) Int. Cl.
*A47L 13/254* (2006.01)
*A47L 13/24* (2006.01)
*B25G 3/38* (2006.01)

(52) U.S. Cl.
CPC ..... *A47L 13/24* (2013.01); *A47L 13/254* (2013.01); *B25G 3/38* (2013.01)

(58) Field of Classification Search
CPC ..... A47L 13/12; A47L 13/20; A47L 13/24; A47L 13/254; A47L 13/256; A47L 13/257; A47L 13/258; A47L 13/42; B25G 3/38
USPC ..... 15/115, 118, 144.1, 144.2, 228, 244.2
See application file for complete search history.

(56) References Cited

U.S. PATENT DOCUMENTS 3,267,505 A * 8/1966 Seufert ..... A47L 13/24 15/144.1
3,419,930 A * 1/1969 Grunert ..... A47L 13/146 15/119.2

(Continued)

FOREIGN PATENT DOCUMENTS

CN 201213777 4/2009
DE 2655930 6/1978

(Continued)

OTHER PUBLICATIONS

Partial machine translation of JP 2002-102133, Apr. 9, 2002.*

(Continued)

*Primary Examiner* — Mark Spisich
(74) *Attorney, Agent, or Firm* — Hamre, Schumann, Mueller & Larson, P.C.

(57) ABSTRACT

Device for cleaning a surface, particularly a floor, comprising:

a cleaning head comprising at least a first surface and a second surface having an angular offset relative to each other about a transverse direction, a hinge comprising a first hinge portion and a second hinge portion which are movable relative to one another in rotation about a hinge axis parallel to the transverse direction, and a switching system, interposed between the cleaning head and the hinge and adapted to move the hinge between a first position near the first surface and a second position near the second surface.

20 Claims, 3 Drawing Sheets

(56) References Cited

U.S. PATENT DOCUMENTS

| | | | | |
|---|---|---|---|---|
| 8,464,389 | B2 * | 6/2013 | Jiang | A47L 13/256 15/118 |
| 2008/0072390 | A1 * | 3/2008 | Strunk | A47L 13/12 15/118 |
| 2011/0047732 | A1 * | 3/2011 | Phillips | B08B 1/00 15/118 |

FOREIGN PATENT DOCUMENTS

| | | | |
|---|---|---|---|
| JP | H04114620 | | 4/1992 |
| JP | 10-43113 | * | 2/1998 |
| JP | 2001-198068 | * | 7/2001 |
| JP | 2001-252230 | * | 9/2001 |
| JP | 2002-102133 | * | 4/2002 |
| JP | 2002-165740 | * | 6/2002 |
| KR | 200165920 | | 2/2000 |
| WO | 97/40736 | | 11/1997 |
| WO | 2007/040463 | | 4/2007 |
| WO | 2011/129741 | | 10/2011 |
| WO | 2013/053160 | | 4/2013 |

OTHER PUBLICATIONS

French Search Report for French Application No. 1359251, Mailed May 27, 2014, 2 pgs.

* cited by examiner

DEVICE COMPRISING A CLEANING HEAD AND A SYSTEM FOR SWITCHING BETWEEN TWO SURFACES

FIELD OF THE INVENTION

The invention relates to a device for cleaning a surface, particularly a floor.

CONTEXT OF THE INVENTION

WO 97/40736 discloses a device for cleaning a surface, particularly a floor, comprising a cleaning head comprising a first surface and a second surface which are both substantially flat and are adapted to alternate in facing the surface to be cleaned, said first surface and second surface having an angular offset relative to one another about a transverse direction, and a hinge comprising a first hinge portion and a second hinge portion which are movable relative to one another in rotation about a hinge axis substantially parallel to the transverse direction, said second hinge portion being intended for connection to a gripping element such as a handle.

Such a device allows placing a cleaning strip on said first and second surfaces in order to clean a larger surface between each rinse/reloading with product, while producing lower friction in contact with the ground.

Although such a device is satisfactory, the invention aims to further improve its cleaning efficiency and ease of use.

DESCRIPTION OF THE DISCLOSURE

To overcome the above problems, the device of the invention further comprises a switching system, interposed between the cleaning head and the hinge and adapted to move said hinge between a first position near the first surface and a second position near the second surface.

The position of the force exerted by the user, generally by means of the handle, on the surface of the cleaning head facing the surface to be cleaned, is thus improved because it is closer to the center of the surface in contact with the ground, regardless of the surface of the cleaning head used. This allows exerting a more uniform pressure on the surface in contact with the ground, which is therefore more effective and reduces the physical effort required from the user.

In addition, the position of the hinge provides better cleaning head stability and prevents unwanted switching between the two surfaces during cleaning.

Finally, the swinging of the hinge simplifies the transition from one surface in contact with the floor to the other, which facilitates the use of the device.

In various embodiments of the device according to the invention, one or more of the following arrangements may be used:

- the switching system guides the hinge in order to move it between the first position and the second position within a switching plane substantially perpendicular to said transverse direction;
- the switching system guides the hinge in rotation about a pivot axis substantially parallel to the transverse direction, between the first position and the second position;
- the hinge abuts against the cleaning head in the first position, while allowing the second hinge portion to pivot relative to the first hinge portion about the hinge axis;

- in the first position, the first hinge portion abuts against the cleaning head substantially in alignment with the hinge axis and the second hinge portion is at a distance from the cleaning head;
- the switching system guides the hinge in translation between the first position and the second position;
- the first surface has a first center, the second surface has a second center, the first center is distanced from the second center by a separation distance, the hinge axis is moved between the first position and the second position by a displacement distance that is between 0.5 and 1.5 times the separation distance; this allows the hinge axis to be substantially in alignment with the center of the surface that is in contact with the floor;
- in the first position, the hinge axis is at a distance of less than 5 centimeters from the first surface, and in the second position the hinge axis is at a distance of less than 5 cm from the second surface;
- the angular offset is between 8 and 90 degrees, preferably between 10 and 20 degrees;
- the first surface has a first length in the transverse direction and a first width perpendicular to the transverse direction, the second surface has a second length in the transverse direction and a second width perpendicular to the transverse direction, the second width being at least 10% and preferably between 25% and 70% smaller than the first width;
- a first cleaning strip portion is held in place opposite the first surface and a second cleaning strip portion is held in place opposite the second surface;
- the first strip portion and the second strip portion have different compositions;
- a handle is connected to the second hinge portion.

BRIEF DESCRIPTION OF FIGURES

Other features and advantages of the invention will be apparent from the following detailed description, with reference to the accompanying drawings in which.

DETAILED DESCRIPTION OF THE DISCLOSURE

Figure 1:
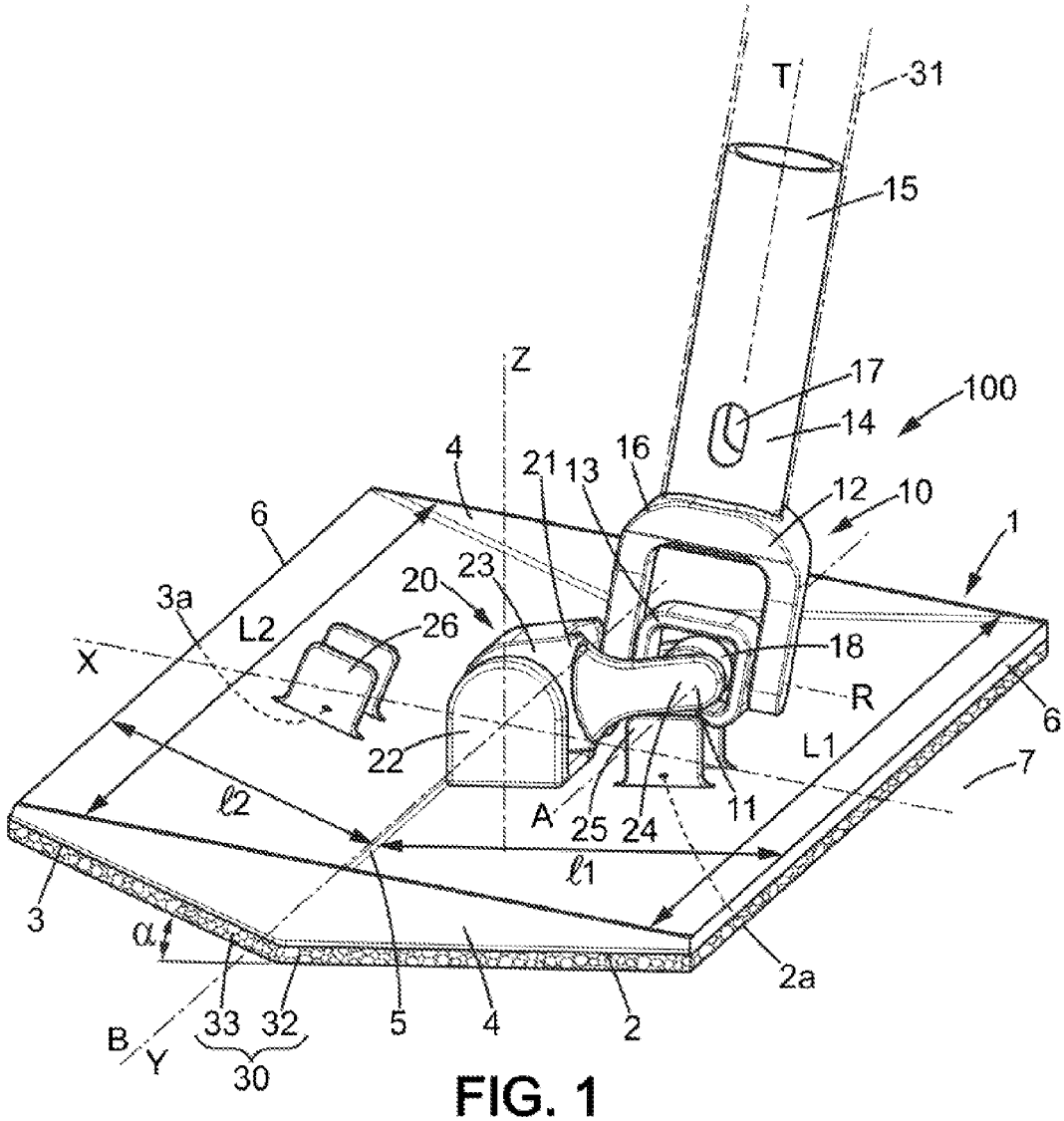
FIG. 1 is a perspective view of a device according to a first embodiment of the invention in a first position.
Figure 2:
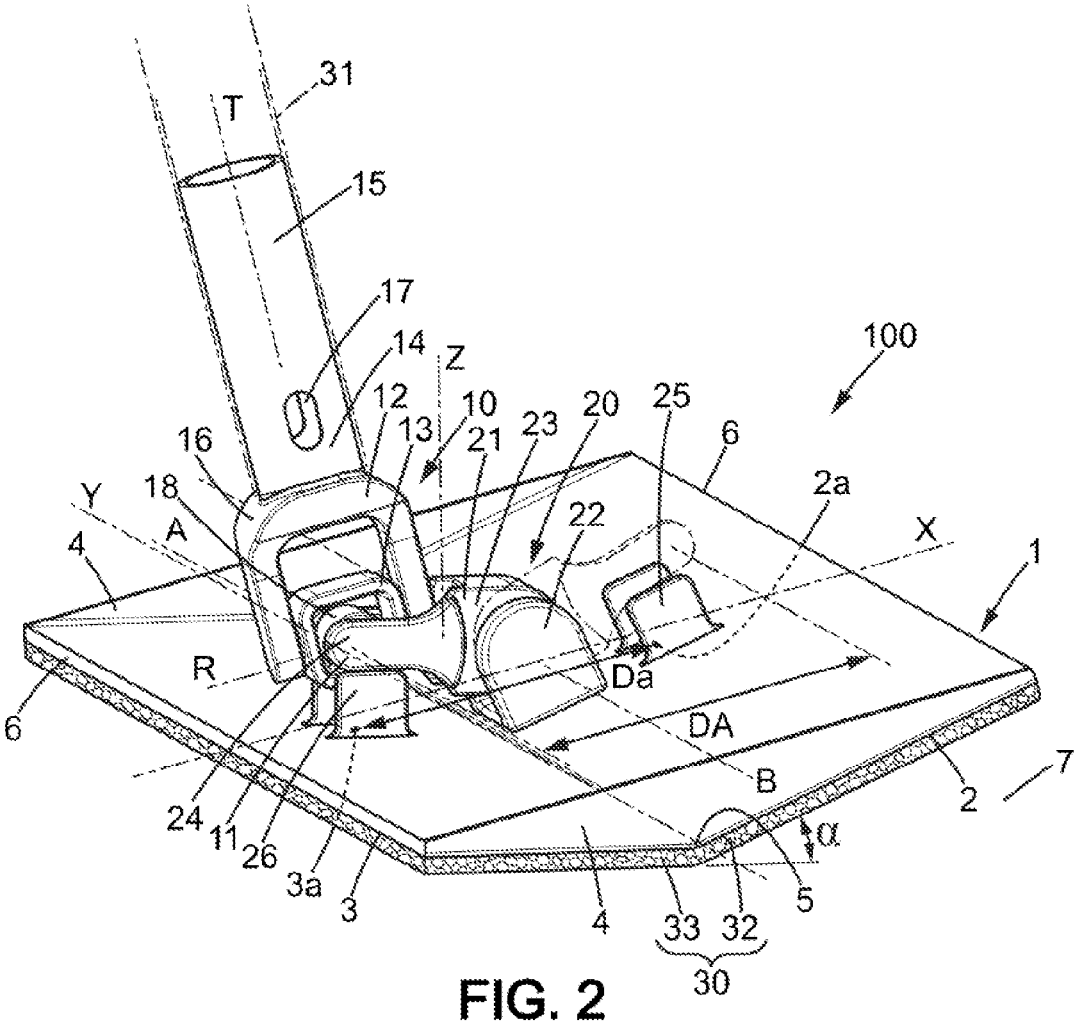
FIG. 2 is another perspective view of the device according to the first embodiment in a second position.

FIGS. 1 and 2 illustrate a device 100 according to a first embodiment, essentially comprising a cleaning head 1, a hinge 10, and a switching system 20.

The cleaning head 1 comprises at least a first surface 2 and second surface 3, both substantially planar. The first surface 2 and the second surface 3 extend in a transverse direction Y and are substantially juxtaposed in a cleaning direction X perpendicular to the transverse direction Y.

The first surface 2 and second surface 3 are connected to each other by means of a connection 5 extending in the transverse direction Y. The connection 5 is composed of a curved portion connecting the first surface 2 and the second surface 3. In preferred embodiments, the connection 5 is narrow. Alternatively, the connection 5 may comprise a third flat surface delimiting the first surface 2 and the second surface 3. In this alternative, the connection 5 may be large enough to separate the first surface 2 and the second surface 3 significantly, or even comprise a third cleaning surface.

The first surface 2 and second surface 3 have an angular offset α relative to each other about the transverse direction Y. Specifically, the angular offset α can be defined by the angle formed between the second surface 3 and a flat floor 7 when the first surface 2 is in contact with this same floor 7, as shown in FIG. 1, or the angle formed between the first surface 2 and a flat floor 7 when the second surface 3 is in contact with this same floor 7, as shown in FIG. 2. The angular offset α is preferably between 8 and 90 degrees, more preferably between 10 and 20 degrees. More particularly, the angular offset α is selected so that the device is ergonomic, with the alternating between the two surfaces 2, 3 being simple for the user and the cleaning head 1 not unexpectedly switching from one surface to the other during cleaning.

The first and second surfaces 2, 3 of the cleaning head 1 are preferably rectangular, but may be any other shape including curved. In particular, the first and second surfaces 2, 3 may have a slightly concave leading edge 6, extending substantially in the transverse direction Y.

The first surface 2 has a first length $L_1$ in the transverse direction Y and a first width $I_1$ perpendicular to the transverse direction Y. The second surface 3 has a second length $L_2$ in the transverse direction Y and a second width $I_2$ perpendicular to the transverse direction Y. The first width $I_1$ and the second width $I_2$ may each be between 4 and 16 cm, preferably between 7 and 9 cm. The first length $L_1$ and the second length $L_2$ are preferably substantially equal and between 25 and 120 centimeters.

The first and second surfaces 2, 3 of the cleaning head 1 may also be of different sizes, as illustrated in FIGS. 1 and 2. Thus, the second width $I_2$ is preferably at least 10% and more preferably between 25 and 70% smaller than the first width $I_1$. Of course, although this is not preferred, the first width $I_1$ and the second width $I_2$ can be equal. The total width of the cleaning head 1 perpendicularly to the transverse direction Y is preferably between 8 and 32 centimeters, more preferably between 14 and 18 centimeters.

The cleaning head 1 further comprises two flanges 4 forming a fin and connecting the first surface 2 and second surface 3 at each of their ends in the transverse direction Y, to strengthen the cleaning head 1. The flanges 4 are substantially planar and have a triangular shape. They extend along the cleaning direction X and along an elevation direction Z perpendicular to the cleaning direction X and to the transverse direction Y. Alternatively, the cleaning head 1 could comprise a first portion comprising the first surface 2 and a second portion comprising the second surface 3, coupled to each other at the connection 5 by a joint rotating about the transverse direction Y, such as a hinge or the like, which allows varying their angular offset α. The angular offset α would then be adjustable between a first angular offset and a second angular offset. The first angular offset is then preferably zero, but could be non-zero. The second angular offset is preferably between 8 and 90 degrees, but may also be equal to 120 degrees or more if desired. In order to maintain the first surface 2 and second surface 3 in the desired position relative to each other, a linkage system (permitting adjustment of the angular offset by discrete values), a screw system with two reverse threads (permitting adjustment of the angular offset by continuous values), or another well-known system may be used.

The switching system 20 is interposed between the cleaning head 1 and the hinge 10, and allows rotating the hinge 10 according to the first embodiment, as illustrated in FIGS. 1 and 2.

The switching system 20 comprises a base 22 and a switching lever 21. The base 22 is fixed to the cleaning head 1 near the center of the cleaning head 1. The switching lever 21 has a first end portion 23 and a second end portion 24. The first end portion 23 is mounted on the base 22 so as to pivot about a pivot axis B substantially parallel to the transverse direction Y.

The hinge 10 comprises a first hinge portion 11 and a second hinge portion 12. The first hinge portion 11 and the second hinge portion 12 are mounted to pivot relative to each other about a hinge axis A substantially parallel to the transverse direction Y and to the pivot axis B.

The first hinge portion 11 comprises the second end portion 24 of the switching lever 21 and a switching rod mounted on the second end portion 24. The second hinge portion 12 comprises a base 14. The base 14 extends in a handle direction T between an upper end portion 15 on which a gripping element 31 formed by a handle is releasably retained, and a lower end portion 16 by which the base 14 is connected to the cleaning head 1.

The hinge 10 further comprises a hub 13 interposed between the base 14 and the switching lever 21. More specifically, the hub 13 is interposed between the first hinge portion 11 and the base 14. The hub 13 comprises a cylinder 18 mounted so as to rotate about the hinge axis A on the switching rod, said hinge axis A passing substantially through the center of said switching rod and cylinder 18.

In addition, the lower end portion 16 of the base 14 is mounted on the hub 13 so as to pivot about an axis of rotation R perpendicular to the hinge axis A. As a result of these two pivoting connections between the base 14 and the first hinge portion 11, the gripping element 31 has two degrees of freedom of rotation relative to the cleaning head 1 during cleaning.

The gripping element 31 is latched into place on the upper end portion 15 of the base 14 by a releasable fastener 17 (only the slots for receiving the releasable retaining pins are shown in FIGS. 1 and 2) by snapping.

The rotation of the switching lever 21 about the pivot axis B moves the hinge 10 between a first position near the first surface 2, shown in FIG. 1, and a second position near the second surface 3, shown in FIG. 2.

First position near the first surface 2 and second position near the second surface 3 are understood to mean that the hinge 10 is nearer to the first surface 2 than the second surface 3 in the first position, and the reverse in the second position. As illustrated, the hinge 10 is still several millimeters or even several centimeters away from the corresponding surface (first surface 2 in the first position/second surface 3 in the second position), but preferably less than 5 cm.

As illustrated in FIG. 1, in the first position, the first portion 11 of the hinge 10, more specifically the second end portion 24 of the switching lever 21, abuts against, substantially in alignment with the hinge axis A, a first support 25 attached to the cleaning head 1 (incorporated into the cleaning head 1 in the embodiment shown) so that the hinge axis A is unmoving relative to the cleaning head 1. The hub 13 and base 14 are at a distance from the cleaning head 1, or in other words it does not come in contact with the cleaning head 1, thereby allowing the second hinge portion 12 to pivot relative to the first hinge portion 11 about the hinge axis A, and preferably about the axis of rotation R.

The first support 25 is arranged on the face opposite the first surface 2 of the cleaning head 1, substantially in alignment with the center 2*a* of the first surface 2. Thus, in the first position the user exerts a force, in the handle direction T, on the cleaning head 1 near the center 2*a* of the first surface 2 in contact with the floor 7, ensuring a satisfactory application of the first surface 2 against the floor 7.

Similarly, as shown in FIG. 2, in the second position, the first portion 11 of the hinge 10, more specifically the second end portion 24 of the switching lever 21, abuts against, substantially in alignment with the hinge axis A, a second support 26 attached to the cleaning head 1 (incorporated into the cleaning head 1 in the embodiment shown) so that the hinge axis A is unmoving relative to the cleaning head 1. The hub 13 and base 14 are at a distance from the cleaning head 1, thereby allowing the second hinge portion 12 to pivot relative to the first hinge portion 11 about the hinge axis A, and preferably about the axis of rotation R.

The second support 26 is arranged on the face opposite the first surface 2 of the cleaning head 1, substantially in alignment with the center 3*a* of the second surface 3. Thus, in the second position the user exerts a force, in the handle direction T, on the cleaning head 1 near the center 3*a* of the second surface 3 in contact with the floor 7.

In the illustrated embodiment, between the first position and the second position, the hinge axis A is moved by a displacement distance $D_A$ substantially equal to the separation distance $D_a$ between the center 2*a* of the first cleaning surface 2 and the center 3*a* of the second cleaning surface 3. Preferably, the displacement distance $D_A$ is between 0.5 times and 1.5 times the separation distance $D_a$ between the center 2*a* of the first cleaning surface 2 and the center 3*a* of the second cleaning surface 3.

The direction of the line passing through the centers 2*a* and 3*a* is thus substantially the cleaning direction X.

In the case where the cleaning surfaces 2, 3 are of complex shapes, the center 2*a* of the first cleaning surface 2 and the center 3*a* of the second cleaning surface 3 respectively correspond to the center of mass of the set of points of each of first and second surfaces.

Figure 3:
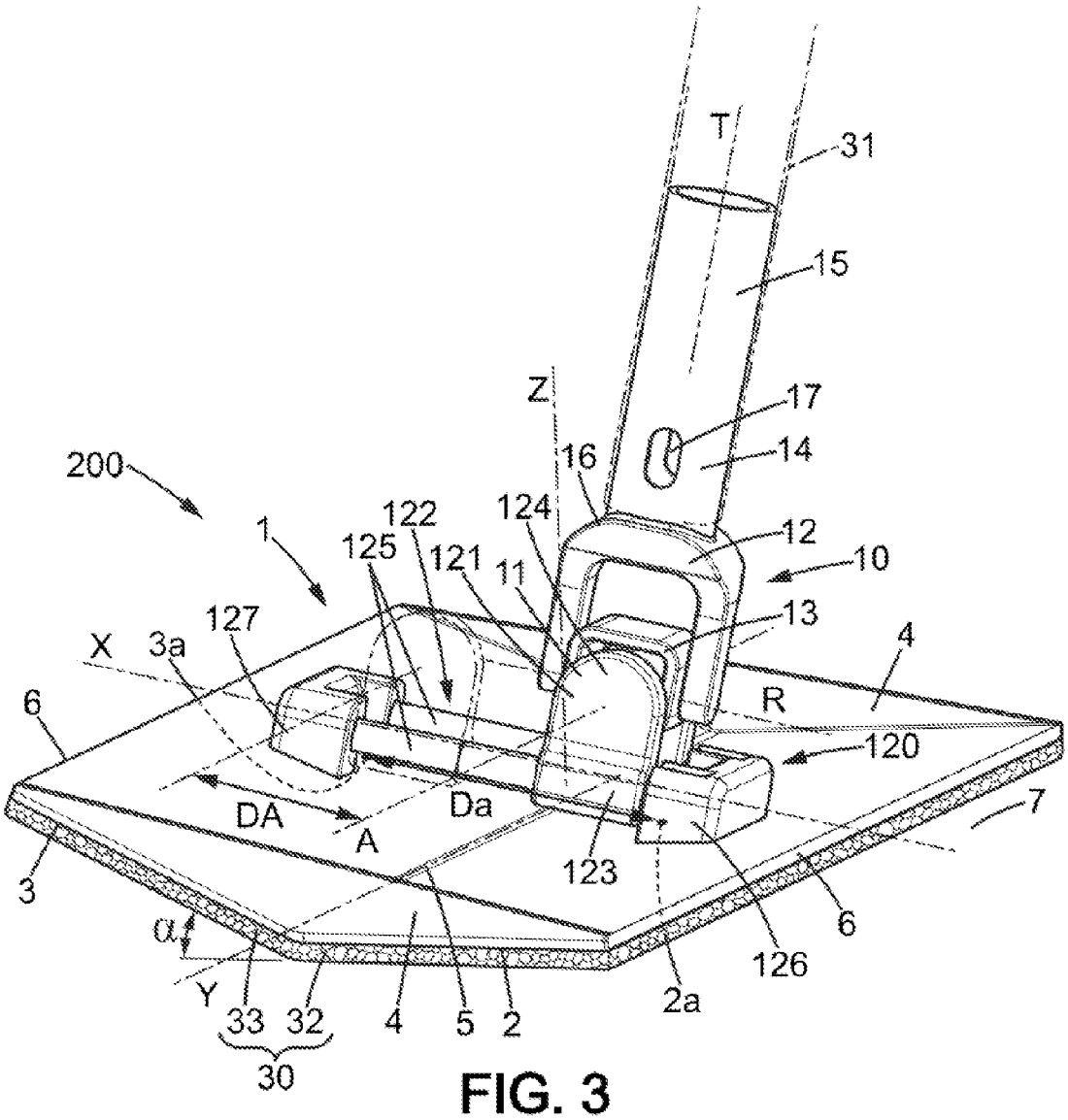
FIG. 3 is a perspective view of a device according to a second embodiment.

FIG. 3 illustrates a device 200 according to a second embodiment. Device 200 differs from device 100 by its switching system 120. The elements of device 200 which are identical to those described in relation to device 100 are denoted similarly.

The switching system 120 is interposed between the cleaning head 1 and the hinge 10 and allows the hinge 10 to move in translation in the cleaning direction X.

The switching system 120 includes a slide base 122 and a slider 121.

The slide base 122 comprises two guide rails 125, a first retention portion 126 and a second retention portion 127. The first retention portion 126 is arranged on the face opposite the first surface 2 of the cleaning head 1, substantially in alignment with the center 2*a* of the first surface 2, and the second retention portion 127 is arranged on the face opposite the second surface 3 of the cleaning head 1, substantially in alignment with the center 3*a* of the second surface 3.

The guide rails 125 extend in the cleaning direction X between the two retention portions 126, 127 which secure the slide base 122 to the cleaning head 1. In the illustrated embodiment, the two guide rails 125 are parallel and rectilinear. The slider 121 has a first end portion 123 and a second end portion 124. The first end portion 123 is mounted so as to slide in translation on the guide rails 125 in the cleaning direction X.

The hinge 10 comprises a first hinge portion 11 consisting of the second end portion 124 of the slider 121 and a second hinge portion 12.

The translation of the slider 121 relative to the slide base 122 moves the hinge 10 between a first position near the first surface 2 and a second position near the second surface 3, as defined above for the first embodiment.

As illustrated in FIG. 3 in the first and second positions, the first hinge portion 10 respectively abuts against the first and second retention portions 126, 127 of the slide base 122, substantially in alignment respectively with the first and second centers 2*a*, 3*a* of the first and second surfaces 2, 3.

The hub 13 and the base 14 are at a distance from the cleaning head 1, thereby allowing the second hinge portion 12 to pivot relative to the first hinge portion 11, about the hinge axis A and preferably about the axis of rotation R.

Thus, in each position, the user exerts a force, in the handle direction T, on the cleaning head 1 near the center 2*a*, 3*a* of the surface 2, 3 in contact with the floor 7, such that the hinge axis A is then stationary relative to the cleaning head 1.

Similarly to the embodiment described above, between the first position and the second position, the hinge axis A is moved by a displacement distance $D_A$ substantially equal to the separation distance $D_a$ between the center 2*a* of the first cleaning surface 2 and the center 3*a* of the second cleaning surface 3; preferably, the displacement distance $D_A$ is between 0.5 times and 1.5 times the separation distance $D_a$ between the center 2*a* of the first cleaning surface 2 and the center 3*a* of the second cleaning surface 3.

In both embodiments, the device 100, 200 further comprises a cleaning strip 30 comprising a first strip portion 32 held in place opposite the first surface 2 and a second strip portion 33 held in place opposite the second surface 3.

Advantageously, the first strip portion 32 and the second strip portion 33 have different compositions. Thus, the first strip portion 32 and the second strip portion 33 fulfill different functions, preferably complementary, among the functions of washing, scrubbing, wiping, etc. For example, the first strip portion 32 is of a composition suitable for washing and/or scrubbing the floor 7 while the second strip portion 33 is of a composition suitable for absorbing liquids in order to wipe off the floor 7.

In the illustrated embodiments, the cleaning strip 30 incorporates the first strip portion 32 and the second strip portion 33 as one piece. Alternatively, the first strip portion 32 and the second strip portion 33 could be separate pieces.

Each of the first and second strip portions 32, 33 is of a known type, and made of polypropylene, polyester, polyamide, or the like, depending on the desired function. The cleaning strip 30 is attached to the cleaning head 1 by known means, in particular using self-adhering surfaces such as Velcro®, magnets, pockets, by press-ins, by brackets, or by tabs.

The cleaning head 1 may also comprise securing means for securing the hinge 10 in one of the first or second positions. These securing means may in particular be magnets, straps, or the like.

Preferably, the cleaning head 1, the hinge 10, and the switching system 20; 120 are made of plastic (polypropylene or similar material), or of metal, preferably aluminum.

Of course, the invention is not limited to these embodiments, as they are described by way of illustration and not limitation. Although this is not preferred, other embodiments can therefore be implemented by combining the two embodiments described, in particular by guiding the hinge 10 simultaneously in a rotational and translational movement.

The invention claimed is:

1. Device for cleaning a surface comprising:

a cleaning head comprising at least a first surface and a second surface which are both flat and are adapted to alternate in facing the surface to be cleaned, said first surface and said second surface having an angular offset relative to one another about a transverse direction, and a hinge comprising a first hinge portion and a second hinge portion which are movable relative to one another in rotation about a hinge axis parallel to the transverse direction, said second hinge portion being intended for connection to a gripping element, wherein the device further comprises a switching system, interposed between the cleaning head and the hinge, and adapted to move said hinge between a first position near the first surface and a second position near the second surface; and first and second supports, or first and second retention portions, projecting upwardly from the cleaning head; the first hinge portion abuts against the first support or the first retention portion when the hinge is in the first position, and the first hinge portion abuts against the second support or the second retention portion when the hinge is in the second position.

2. Device according to claim 1, wherein the hinge is movable between the first position and the second position in a plane that is perpendicular to the transverse direction.

3. Device according to claim 1, wherein said angular offset is between 8 and 90 degrees.

4. Device according to claim 1, wherein:

the first surface has a first length in the transverse direction and a first width perpendicular to the transverse direction, the second surface has a second length in the transverse direction and a second width perpendicular to the transverse direction, the second width is at least 10% smaller than the first width.

5. Device according to claim 1, further comprising a first cleaning strip portion held in place opposite the first surface and a second cleaning strip portion held in place opposite the second surface, the first strip portion and the second strip portion having different compositions.

6. Device according to claim 1, wherein said angular offset is between 10 and 20 degrees.

7. Device according to claim 1, wherein the first and second supports, or the first and second retention portions, project upwardly from the cleaning head substantially in alignment with a center of the first surface and a center of the second surface, respectively.

8. Device according to claim 1, wherein the first position is near the center of the first surface and the second position is near the center of the second surface.

9. Device for cleaning a surface comprising:

a cleaning head comprising at least a first surface and a second surface which are both flat and are adapted to alternate in facing the surface to be cleaned, said first surface and said second surface having an angular offset relative to one another about a transverse direction, and a hinge comprising a first hinge portion and a second hinge portion which are movable relative to one another in rotation about a hinge axis parallel to the transverse direction, said second hinge portion being intended for connection to a gripping element, a switching system, interposed between the cleaning head and the hinge, and adapted to move said hinge between a first position near the first surface and a second position near the second surface; and first and second supports projecting upwardly from the cleaning head; the first hinge portion abuts against the first support when the hinge is in the first position, and the first hinge portion abuts against the second support when the hinge is in the second position, wherein the hinge is rotatable about a pivot axis that is parallel to the transverse direction when moving between the first position and the second position.

10. Device according to claim 9, wherein at the first position the second hinge portion is pivotable relative to the first hinge portion about the hinge axis.

11. Device according to claim 10, wherein, in the first position, the first hinge portion abuts against the first support in alignment with the hinge axis, and the second hinge portion is spaced a distance from the cleaning head.

12. A device for cleaning a surface comprising:

a cleaning head that includes a first surface and a second surface which are both flat and are adapted to alternate in facing the surface to be cleaned, the first surface and the second surface having an angular offset relative to one another about a transverse direction;

the cleaning head further includes a first face opposite the first surface and a second face opposite the second surface, the first face and the second face having an angular offset relative to one another about the transverse direction;

a hinge connected to the cleaning head by a switching system, the hinge includes a first hinge portion and a second hinge portion which are movable relative to one another in rotation about a hinge axis parallel to the transverse direction, the second hinge portion being intended for connection to a gripping element; and the switching system is interposed between the cleaning head and the hinge, and the switching system is configured to move the hinge between a first position near the first surface and a second position near the second surface.

13. The device of claim 12, further comprising first and second supports, or first and second retention portions, projecting upwardly from the first face and the second face, respectively; the first hinge portion abuts against the first support or the first retention portion when the hinge is in the first position, and the first hinge portion abuts against the second support or the second retention portion when the hinge is in the second position.

14. The device of claim 13, wherein, in the first position, the first hinge portion abuts against the first support or the first retention portion in alignment with the hinge axis, and the second hinge portion is spaced a distance from the cleaning head.

15. The device of claim 13, wherein the first and second supports, or the first and second retention portions, project upwardly from the first face and the second face, respectively, substantially in alignment with a center of the first surface and a center of the second surface, respectively.

16. The device of claim 12, wherein the hinge is rotatable about a pivot axis that is parallel to the transverse direction when moving between the first position and the second position.

17. The device of claim 16, wherein at the first position the second hinge portion is pivotable relative to the first hinge portion about the hinge axis.

18. The device of claim 12, wherein:

the first surface has a first length in the transverse direction and a first width perpendicular to the transverse direction;

the second surface has a second length in the transverse direction and a second width perpendicular to the transverse direction; and the second width is at least 10% smaller than the first width.

19. The device of claim 12, further comprising a first cleaning strip portion held in place opposite the first surface and a second cleaning strip portion held in place opposite the second surface, the first strip portion and the second strip portion having different compositions.

20. The device of claim 12, wherein the first position is near the center of the first surface and the second position is near the center of the second surface.

* * * * *